US009033684B2

(12) United States Patent
Long et al.

(10) Patent No.: US 9,033,684 B2
(45) Date of Patent: May 19, 2015

(54) VENTILATING FAN

(75) Inventors: Min Long, Guangdong (CN); Bodong Zhong, Guangdong (CN); Ryuuma Yokoyama, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 180 days.

(21) Appl. No.: 13/457,666

(22) Filed: Apr. 27, 2012

(65) Prior Publication Data

US 2012/0275938 A1 Nov. 1, 2012

(30) Foreign Application Priority Data

Apr. 29, 2011 (CN) ..... 2011 1 0115795
Feb. 24, 2012 (CN) ..... 2012 1 0045116

(51) Int. Cl.
*F24F 7/007* (2006.01)
*F04D 25/06* (2006.01)

(52) U.S. Cl.
CPC ..... *F24F 7/007* (2013.01); *F04D 25/0693* (2013.01)

(58) Field of Classification Search
CPC ..... F24F 7/00; F24F 7/13; F24F 13/0209; F24F 7/007; F04D 25/0693
USPC ..... 417/423.1, 423.14; 415/223, 201, 415/213.1, 214.1, 215.1, 232; 454/341, 14, 454/271, 276, 350, 307
See application file for complete search history.

(56) References Cited

U.S. PATENT DOCUMENTS 2,619,021 A * 11/1952 Pfautsch ..... 454/292
4,843,298 A * 6/1989 Brauch et al. ..... 320/115

FOREIGN PATENT DOCUMENTS

JP 2001336795 A * 12/2001
JP 2005-083587 * 3/2005
JP 4391168 12/2009

OTHER PUBLICATIONS

Machine Translation of the Publication No. JP 2005-83587.*
Raw Machine Translation of the Japanese Publication JP 2001-336795A, Makino et alo., Ventilator, Dec. 2001.*

* cited by examiner

*Primary Examiner* — Charles Freay
*Assistant Examiner* — Lilya Pekarskaya
(74) *Attorney, Agent, or Firm* — RatnerPrestia

(57) ABSTRACT

A ventilating fan comprises a ventilating fan body, a ventilating fan mounting member, and a power supply case. A power supply wire disposed in the ventilating fan body to be connected to a blower is provided with an internal terminal at a leading end of the power supply wire. The power supply case projects from the power supply opening to be located outside the cylinder of the ventilating fan mounting member, and is fixed to the ventilating fan mounting member from the indoor side. An external terminal is mounted on an indoor side of the power supply case. An external electric wire for supplying electric power to the ventilating fan is connected with the external terminal in the power supply case, and the internal terminal is connected with the external terminal, so that the connection operation becomes simpler.

9 Claims, 11 Drawing Sheets

VENTILATING FAN

BACKGROUND OF THE INVENTION

1. Field of the Invention

The present invention pertains to a ventilation device, and in particular to a ventilating fan in which a sleeve or an air discharge pipe is mounted to communicate an inside of a room with an outside of the room and which discharges air from the inside of the room to the outside of the room or pumps air from the outside of the room to the inside of the room to ventilate the room.

2. Description of the Related Art

In general, this kind of ventilating fan in related art is inserted in a wall from an inside of an room and a sleeve or an air discharge pipe is mounted in the ventilating fan to communicate the inside of the room with the outside of the room, and a terminal is disposed in a body to be connected to an external electric wire, for example, as disclosed in JP Pat. No. 4391168.

This kind of ventilating fan is described as below with reference to FIG. 11.

As illustrated in FIG. 11, the ventilating fan comprises a resin body 501 as a body and a blower. The resin body 501 has a cylindrical wind tunnel 500 in which a sleeve or the like is inserted, and the blower comprises a propeller blade 502 and a motor 503. An opening edge of an opening of the body 501 which is located in front of the wind tunnel 500 to form a suction port or a discharge port has a generally square flange 504 extending in a radial direction. A protrusion 506 is disposed at an edge of a planar portion 505 of the flange 504 extending in the radial direction, and the protrusion 506 is disposed such that it has an end surface adjoining a wall surface on an indoor side and protrudes towards a back side. A rear end side of the wind tunnel 500 is formed integrally with a motor mounting structure 507.

A receiving portion adjoining a back of the flange 504 is formed by disposing the cylindrical wind tunnel 500 of the body 501, the generally square flange 504, and the protrusion 506 of the flange 504 around the receiving portion. A container 509 receives a capacitor or a power switch for connection to the motor 503 in a state that the capacitor or the power switch is electrically connected with a quick-connection terminal 508, and is detachably embedded in the receiving portion.

Connection with a lead wire projecting from the motor 503 is partly carried out on an upper side of the container 509, and connection between the quick-connection terminal 508 and an external electric wire 510 is partly performed at an opening portion on a lower side of the container. When the connection is completed, the opening portion is covered by a cover 511. Furthermore, a detachable decorative panel 512 configured to surround the flange 504 is mounted on the flange 504 constituting a front portion of the body 501.

In general, when a size of the flange of such an existing ventilating fan is around 160 mm, the protrusion has a height of around 20 mm. Therefore, space surrounding by the flange and the protrusion of the ventilating fan is very finite. The external electric wire usually needs to be received in this space to be not exposed from the body. The external electric wire is usually disposed in a wall in advance and then led out by a reserved length from the inside of the wall. In order that the external electric wire can be completely received in the space, therefore, it is necessary to try to make the reserved length of the external electric wire as short as possible, which also causes operation of wire connection between the external electric wire and the body to be carried out only inside the body. However, the external electric wire arranged in advanced is a general VVF cable (Vinyl insulated Vinyl sheathed Flat-type cable) for indoor wiring, and comprises single-conductor wires with conductors having a diameter of 1.6 mm. The complete electric cable uniting insulator of the single-conductor wires and sealing plastic part in which two single-conductor wires are disposed has a cross section of a size of 42 mm×9.4 mm and is thick and hard. Therefore, the ventilating fan has the problem that operability of connection of the electric wire inside the body and receiving of the electric wire is poor.

Hence, in order to solve the above problem in the related art, the present invention provides a ventilating fan by means of which an external electric wire can be simply connected with a local power supply wire and which can be simply mounted.

SUMMARY OF THE INVENTION

In order to achieve the above object, the present invention provides a ventilating fan comprising a ventilating fan body, a ventilating fan mounting member, and a power supply case. The ventilating fan mounting member is disposed at a penetrating section formed between an inner wall and an outer wall to mount the ventilating fan body. The ventilating fan body comprises a wind tunnel part, a body flange, a blower for blowing through the penetrating section, a power supply wire connected to the blower, and an internal terminal disposed at a leading end of the power supply wire. The ventilating fan mounting member comprises a cylinder and a component flange, the cylinder is provided with a power supply opening, and the component flange is formed to protrude towards an outer periphery from an opening edge of the cylinder on an indoor side. The power supply case projects from the power supply opening to be located outside the cylinder, and is fixed to the ventilating fan mounting member from the indoor side. An external terminal is mounted on an indoor side of the power supply case. The ventilating fan is supplied with electric power with an external electric wire connected with the external terminal in the power supply case, and the internal terminal is connected with the external terminal.

The component flange is provided with a plurality of body mounting parts. The body flange is provided with a plurality of body fixing sections. The ventilating fan body is fixedly mounted to the ventilating fan mounting member by mounting the body fixing sections to the body mounting parts.

An inner wall opening disposed in the inner wall to form the penetrating section is configured to match with the cylinder of the ventilating fan mounting member and shape of the power supply case. A part of the cylinder of the ventilating fan mounting member and a part of the power supply case are located in the inner wall opening.

The cylinder of the ventilating fan mounting member is a two-segment cylinder having first and second cylinders. The first cylinder has a depth dimension less than or equal to a thickness of the inner wall, and a diameter of the first cylinder is larger than a diameter of the second cylinder. A third power supply opening is disposed in a cylindrical surface of the second cylinder, and a fourth power supply opening is disposed in a segment difference part between the first and second cylinders to adjoin the third power supply opening. The fourth power supply opening reaches a cylindrical surface of the first cylinder, and the third and fourth openings form a power supply opening corresponding to the power supply case together.

A centerline of the first cylinder and a centerline of the second cylinder do not coincide with each other, and the second cylinder is formed to be staggered downwards.

The inner wall opening disposed in the inner wall to form the penetrating section is disposed to match with a size of the first cylinder, and a part of the first cylinder is located in the inner wall opening.

An opening, through which a terminal lead wire of the external terminal is projected, is disposed on the indoor side of the power supply case.

A front panel is also disposed to surround an outer periphery of the body flange of the ventilating fan body, and detachably mounted.

When the ventilating fan mounting member according to the present invention is mounted to the penetrating section of the inner and outer walls and the component flange of the ventilating fan mounting member is fixed to the inner wall with screws, positions of the ventilating fan body and the power supply case can correctly be ensured, and the mounting can be simply and reliably carried out since the ventilating fan body and the power supply case are mounted with the ventilating fan mounting member served as foundation, respectively.

According to the present invention, the power supply case can also be fixed to the ventilating fan mounting member from the indoor side, and the external electric wire is connected with the external terminal in the power supply case. When the ventilating fan body is mounted to the ventilating fan mounting member, the electrical connection operation is completed by connecting the external terminal and the internal terminal of the power supply wire of the ventilating fan body. It is not necessary to adjust size of the external electric wire to accommodate the mounting of the ventilating fan. Therefore, the external electric wire arranged inside the walls can be simply connected with the power supply wire of the body and thus the ventilating fan can be simply mounted.

Furthermore, the inner wall opening disposed in the inner wall for the penetrating section is an opening configured to match with the cylinder of the ventilating fan mounting member and shape of the side of the protruded power supply case. With the configuration, the inner wall opening is formed opposite to the side of the power supply case. Therefore, when the internal terminal of the power supply wire of the ventilating fan body is connected with the external terminal mounted at the side of the power supply case, not only the connection can be simply carried out from the indoor side, but the power supply wire and the like also will not affect ventilation performance since the power supply wire does not need to pass through the cylinder of a ventilation path of the ventilating fan body.

If the opening, through which a terminal lead wire of the external terminal is projected, is disposed on the indoor side of the power supply case, then the connection of the internal terminal of the power supply wire led out from the body electrical case and the external terminal can be carried after the ventilating fan body is fixed, so that the connection operation becomes simpler.

When the cylinder of the ventilating fan mounting member is the two-segment cylinder having the first and second cylinders as described above, an opening for connection is formed in an outer periphery of the second cylinder as a ventilation flow path so that the internal terminal can be connected with the external terminal mounted at the side of the power supply case and thus the connection operation becomes simpler if the opening is formed in the inner wall to match with the diameter of the first cylinder.

DETAILED DESCRIPTION OF THE EMBODIMENTS

A further description of the invention will be made as below with reference to embodiments of the invention taken in conjunction with the accompanying drawings.

Embodiment 1

Figure 1:
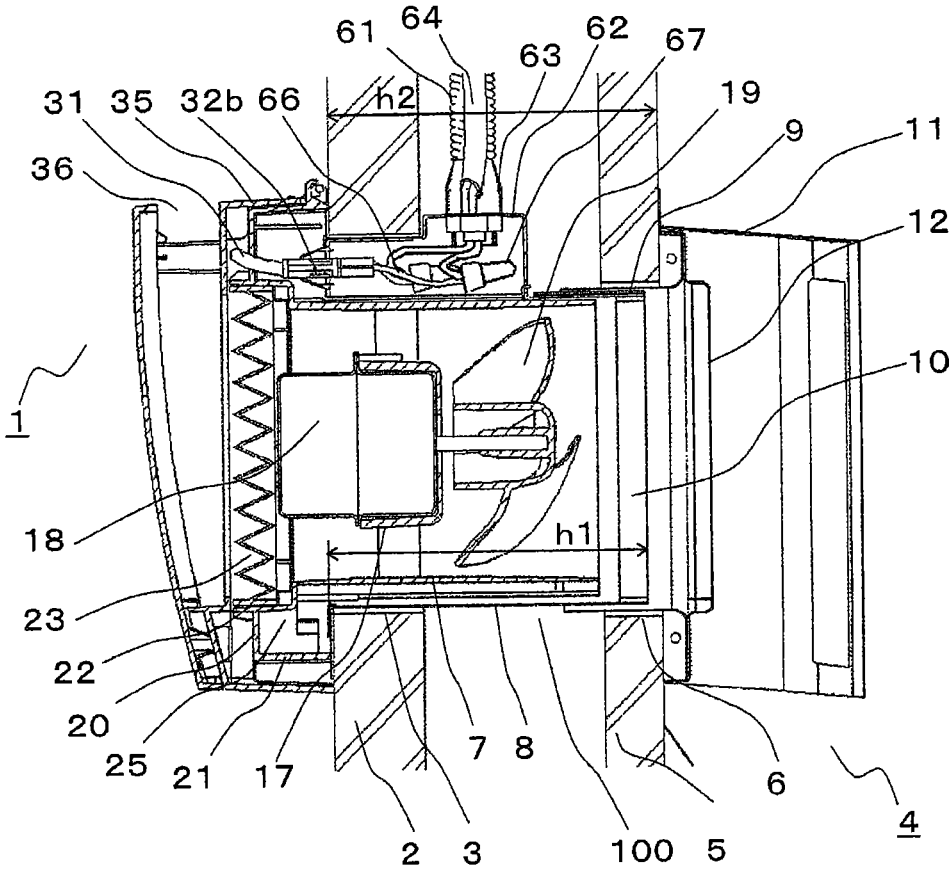
FIG. 1 is a sectional view of a mounted ventilating fan according to a first embodiment.
Figure 2:
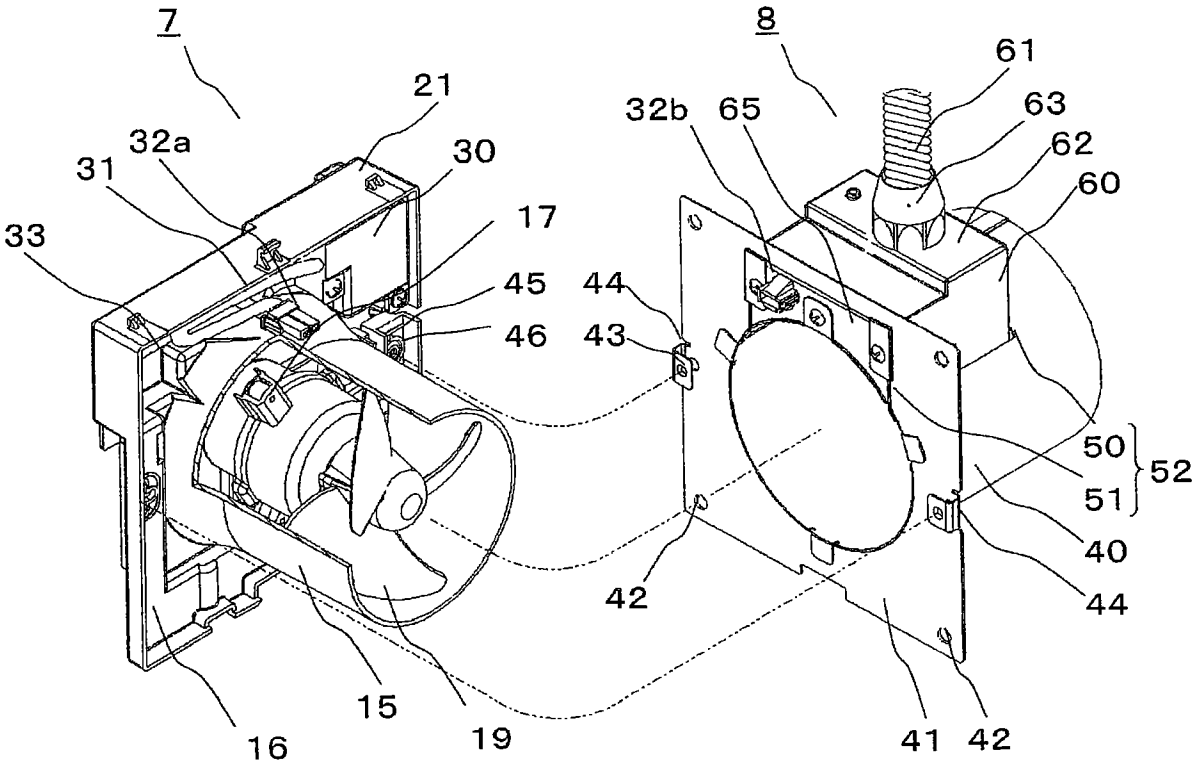
FIG. 2 is a schematic exploded view of the ventilating fan according to the first embodiment.
Figure 3:
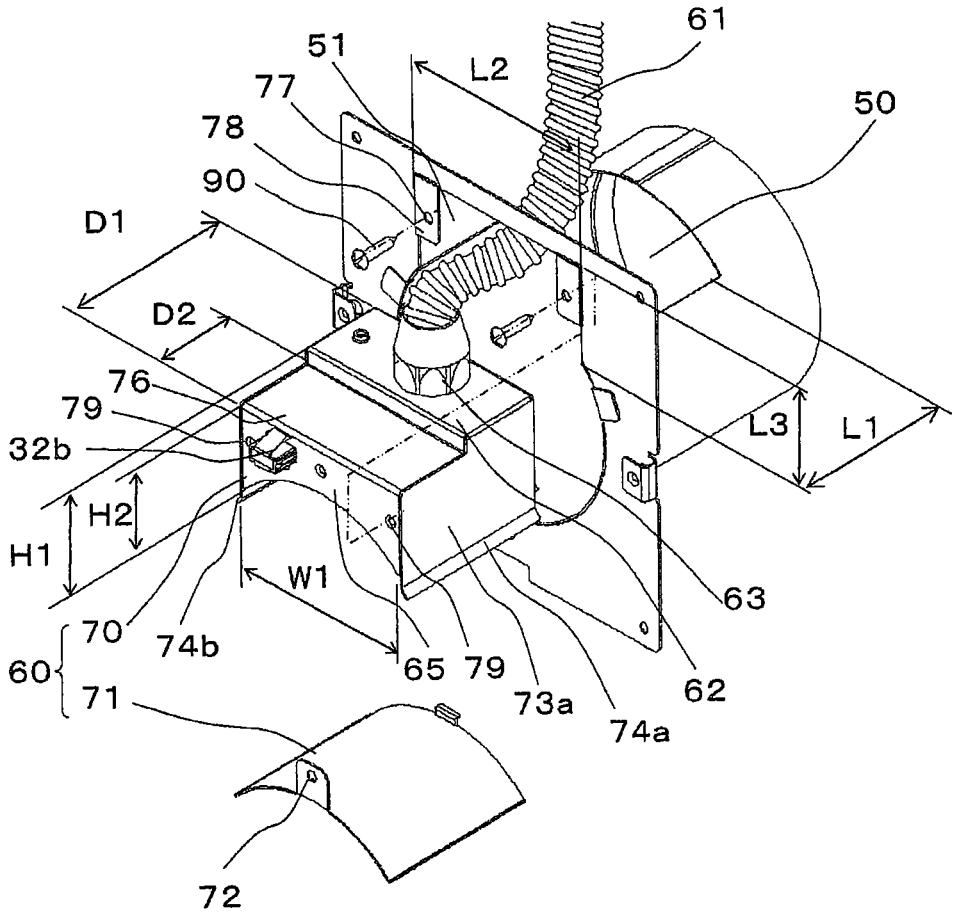
FIG. 3 is a schematic view showing structure of a ventilating fan mounting member and a power supply case of the ventilating fan according to the first embodiment.

FIG. 1 is a sectional view of a mounted ventilating fan according to a first embodiment of the present invention, FIG. 2 is a schematic exploded view of the ventilating fan according to the first embodiment of the present invention, and FIG. 3 is a schematic view showing structure of a ventilating fan mounting member and a power supply case of the ventilating fan according to the first embodiment of the present invention.

As illustrated in FIGS. 1 and 2, an inner wall opening 3 is disposed in an inner wall 2 facing an indoor side 1 of a building, an outer wall opening 6 is disposed in an outer wall 5 facing an outdoor side 4, and the inner wall opening 3 and the outer wall opening 6 are formed opposite to each other. A penetrating section 100 is formed between the inner wall 2 and the outer wall 5.

A ventilating fan according to the first embodiment of the present invention comprises a ventilating fan body 7, a ventilating fan mounting member 8, and a power supply case 60. In order to mount the ventilating fan body 7, the ventilating fan mounting member 8 is disposed at a penetrating section 100 in such a way that it is mounted from the indoor side 1 towards the inner wall 2. Since a dimension h1 by which the ventilating fan mounting member 8 projects into the penetrating section 100 is less than an outer dimension h2 between the inner wall 2 and the outer wall 5, the ventilating fan mounting member 8 is extended and shielded by disposing an auxiliary sleeve 9 from the outside 4 to form a ventilation path 10. Furthermore, when the outdoor side 4 is a side outside of the building, an outdoor tubular shield 11 is disposed to shield an outdoor side opening 12 from ingress of outdoor raindrop and the like.

The ventilating fan body 7 comprises a wind tunnel part 15 and a body flange 16, and has a blower for blowing through the penetrating section 100 and a power supply wire 31 connected to the blower. The wind tunnel part 15 is cylindrical in shape, a motor support 17 is disposed in the wind tunnel part 15, and a motor 18 is fixed to the motor support 17. A fan 19 is fixed on a shaft of the motor to pump air from the outdoor side 4.

On the other hand, the body flange 16 is formed such that it extends radially in a generally square shape from an opening edge of an opening of the wind tunnel part 15 on the indoor side 1. A protrusion 21 is disposed to protrude from an edge of a planar portion 20 of the body flange 16 towards a back side of the body flange 16. An end surface of the protrusion 21 adjoins the inner wall 2. Furthermore, an opening is disposed at a center of the planar portion 20 of the body flange 16, a quadrangular filter screen frame 22 is disposed around the opening, and integrally formed to protrude towards the indoor side, and a detachable quadrangular filter screen 23 is disposed in the filter screen frame 22. Therefore, a spatial receiving compartment 25 adjoining a back of the body flange 16 is formed by disposing the cylindrical wind tunnel part 15 of the ventilating fan body 7, the generally square planar portion 20, and the protrusion 21 of the planar portion 20 around the spatial receiving compartment 25.

A body electrical case 30 is received in a part of the receiving compartment 25, and accommodates a capacitor or a switch for driving the motor 18 and electrical circuit components, such as electric wire, connected with the capacitor or switch. Furthermore, a power supply wire 31 for receiving electric power is led out from the body electrical case 30 in such a way that it is protected with an insulating sleeve, while an electric wire for the motor 18 is disposed in the body electrical case 30. An internal terminal 32*a* is mounted at a leading end of the power supply wire 31. A space of the receiving compartment 25 remaining after receiving the body electrical case 30 is used as a power supply wire receiving compartment 33, and the power supply wire 31 is received in a apace of the power supply wire receiving compartment 33.

In addition, a front panel 35 is detachably mounted to surround an outer periphery of the body flange 16 of the ventilating fan body 7. Furthermore, an opening is provided at an upper portion of the front panel 35 to form an air outlet 36.

The ventilating fan mounting member 8 comprises a cylinder 40 and a component flange 41. The component flange 41 is formed to protrude towards an outer periphery from an opening edge of the cylinder 40 on the indoor side 1. In other words, the component flange 41 is formed such that it extends radially in a generally square shape from the opening edge of the opening. A plurality of screw holes 42 are formed in a surface of the component flange 41 adjoining the inner wall 2. The component flange 41 is dimensioned such that it can be just assembled in the receiving compartment 25 formed by the back of the body flange 16. In addition, the component flange 41 is provided with a plurality of body mounting parts 44 and screw holes 43 are disposed in respective center portions of the body mounting parts 44. The body mounting parts 44 protrude towards the indoor side 1 to have a L-shape. Body fixing sections 45 are disposed at positions on the ventilating fan body 7 side which are connected with the body mounting parts 44 when the ventilating fan body 7 is inserted in the ventilating fan mounting member 8. Screw holes 46 are disposed at portions on the body fixing sections 45 corresponding to the screw holes 43 of the body mounting parts 44.

An opening is formed in a part of a cylindrical surface of the cylinder 40 connected with the component flange 41 to constitute a first power supply opening 50, and a second power supply opening 51 adjoining the first power supply opening 50 is disposed in a part of the component flange 41 connected with the cylinder 40. In other words, the first power supply opening 50 and the second power supply opening 51 form a power supply opening 52 having an L-shaped section. Furthermore, a power supply case 60 is disposed to protrude outwards from the power supply opening 52.

The power supply case 60 has a shape of a box and is made of sheet metal. A flexible conduit 61 disposed between the inner wall 2 and the outer wall 5 penetrates a first top surface 62 at an upper portion of the power supply is case 60, and is connected by a conduit connecting member 63. An external electric wire 64 for supplying power is arranged in the conduit 61. A side of the power supply case 60 on the indoor side 1 is a first side 65. An external terminal 32*b* connectable with the internal terminal 32*a* of the power supply wire 31 is mounted at the first side 65. As illustrated in FIG. 1, a terminal lead wire 66 connected with the external terminal 32*b* may be connected to the external power supply wire 64 through a close-end connector 67.

The ventilating fan mounting member 8 and the power supply case 60 will now be described in detail with referent to FIG. 3.

As illustrated in FIG. 3, the power supply case 60 comprises a case-shaped power supply box 70, and a power supply box cover 71. The power supply box cover 71 has an arc-shaped section shape having the same curvature as the cylindrical surface of the cylinder 40. The power supply box cover 71 is provided with a mounting sheet 72, and a hole is formed in a center portion of the mounting sheet 72. The mounting sheet 72 adjoins the first side 65 of the power supply box 70 and is fixed to the first side 65 of the power supply case 70 with a screw. Furthermore, supporting sheets 74*a* and 74*b* are respectively disposed at a second side 73*a* of the power supply box 70 and a third side of the power supply box 70 opposite to the second side 73*a* to be parallel to an axial direction of the cylinder 40. The supporting sheets 74*a* and 74*b* are formed such that they are bent and protruded from the power supply box 70 towards both sides in the same curvature as that at an inner diameter of the cylinder 40.

A depth dimension D1 of the power supply case 60 is equal to an opening depth dimension L1 of the first power supply opening 50 disposed in the cylinder 40. All of the depth dimensions of the respective components described in the present invention are measured in a length direction of the cylinder. A width dimension W1 (an outer dimension measured from the second side 73*a* to the third side) of the power supply case 60 is equal to an opening width dimension L2 of the second power supply opening 51. A second top surface 76 is formed at the first top surface 62 at the upper portion of the power supply case 60 with a segment difference between the first top surface 62 and the second top surface 76. A depth dimension D2 of the second top surface 76 is equal to or slightly larger than a thickness of the inner wall 2. Since the segment difference is formed between the first top surface 62 and the second top surface 76, a height dimension of the power supply case 60 (a height dimension of the second side 73*a* and the third side) refers to a height dimension H1 from an intersection line between the supporting sheet 74*a* and the second side 73*a* or an intersection line between the supporting sheet 74*b* and the third side to the first top surface 62, and a height dimension H2 from the intersection line between the supporting sheet 74*a* and the second side 73*a* or the intersection line between the supporting sheet 74*b* and the third side to the second top surface 76. A height dimension L3 of the second power supply opening 51 disposed in the component flange 41 is equal to the height dimension H2. In addition, it is most ideal to set the height dimension H2 of the power supply case 60 to be able to accommodate the mounting sheet 72, and to set the height dimension H2 of the power supply case 60 to a minimum dimension to enable the external terminal 32*b* to be mounted to the first side 65, in consideration of operability of formation of the inner wall opening 3 in the inner wall 2.

Furthermore, the width dimension W1 and the height dimension H1 of the power supply case 60 are set so that the power supply case 60 can be just inserted in the cylinder 40.

A power supply case fixing portion 78 is disposed at the second power supply opening 51 of the component flange 41. The power supply case fixing portion 78 projects towards the second power supply opening 51 and is provided with a screw hole 77 formed in a center portion of the power supply case fixing portion 78. The first side 65 of the power supply case 60 adjoins a back side of the power supply case fixing portion 78 and is then fixed to the back side of the power supply case fixing portion 78 by passing a screw 80 through a screw hole 79 disposed in the first side 65. In other words, an opening shape of the inner wall opening 3 disposed in the inner wall 2 is formed by a circular shape, in which the cylinder 40 can be inserted, and a quadrangular opening opposite to the second power supply opening 51. The second top surface 76 formed at the indoor side of the power supply case 60 is received in the inner wall opening 3.

With the above configuration, the ventilating fan mounting member 8 is inserted in the inner wall opening 3 from the indoor side 1 so that the component flange 41 adjoins the inner wall 2, and then fixed to the inner wall 2 by passing screws through the plurality of screw holes 42. Meanwhile, the conduit 61, disposed in advance to coordinate with construction engineering of the building, guides the leading end of the external electric wire 64 from the opening of the component flange 41 to the indoor side 1. Then, the conduit 61 is connected with the top surface 62 of the power supply case 60 by means of the conduit connecting member 63. Furthermore, the terminal lead wire 66 can be connected with the external electric wire 64 through the close-end connector 67. The remaining portions of the terminal lead wire 66 and the external electric wire 64 can be received in the power supply case 60. If the height dimension H2 of the second top surface 76 of the power supply case 60 is set to the minimum dimension in consideration of the operability of formation of the inner wall opening 3 in the inner wall 2 as described above, an inner volume of the power supply case 60 is enlarged by setting the height dimension H1 of the first top surface 62 to be larger than the height dimension H2 if it is difficult for the power supply case 60 to receive the remaining portions of the terminal lead wire 66 and the external electric wire 64. The power supply case 60 can accommodate the remaining portions of the terminal lead wire 66 and the external electric wire 64 by means of the enlarged portion of the power supply case 60. The power supply box cover 71 covers the power supply box 70. If the power supply box cover 71 is fixed by passing screws through the mounting sheet 72, the power supply case 60 connected with the external electric wire 64 is prepared in the proximity of the inner wall opening 3.

Next, when the power supply case 60 is inserted in the cylinder 40, it is inserted in such a way that the first side 65 faces the indoor side 1 and the power supply case is offset towards a lower side of the cylinder 40 to avoid the power supply case fixing portion 78 of the component flange 41. When the first side 65 of the power supply case 60 is inserted to a position on the back side of the power supply case fixing portion 78, the power supply case 60 is projected from the first power supply opening 50 to move upwards. At this point, the flexible conduit 61 is pushed back to the space between the inner wall 2 and the outer wall 5. Since the first side 65 adjoins the back side of the power supply case fixing portion 78, and the screw hole 77 disposed in the center portion of the power supply case fixing portion 78 is aligned with the screw hole 79 disposed in the first side 65, the power supply case 60 is fixed by screws 90 from the indoor side 1. When the power supply case 60 is projected from the first power supply opening 50 to move upwards, the supporting sheets 74*a* and 74*b* adjoin an inner wall of the cylinder 40 to perform a positioning function. When the power supply case 60 is fixed, it projects from the power supply opening 52 to be located outside the cylinder 40. The power supply case 60 can be fixed to the ventilating fan mounting member 8 from the indoor side. At this point, the first power supply opening 50 is covered by the power supply box cover 71, and the cylinder 40 and the power supply box cover 71 form a cylindrical compartment which can receive the wind tunnel part 15 of the ventilating fan body 7. In addition, the second power supply opening 51 is covered by the first side 65 of the power supply box 70. Moreover, preparation for mounting the ventilating fan body 7 has been completed since the external terminal 32*b* can be connected and arranged from the indoor side 1.

Finally, the internal terminal 32*a*, mounted at the leading end of the power supply wire 31 led out from the body electrical case 30, is first is connected with the external terminal 32*b* when the ventilating fan body 7 is mounted. Furthermore, the power supply wire 31 is received in the power supply wire receiving compartment 33, and the body fixing sections 45 of the ventilating fan body 7 is mounted to be fixed to the ventilating fan body mounting parts 44 of the ventilating fan mounting member 8 by screws.

Therefore, since the external electric wire 64 is connected with the terminal lead wire 66 in the power supply case 60 in advance when the ventilating fan body 7 is mounted, it is not necessary to adjust dimension of the external electric wire 64, the external electric wire 64 arranged inside the wall can be simply connected with the body power supply wire 31 through the terminals, and the present invention can achieve effect of simple mounting of the ventilating fan body 7.

Thickness of the power supply wire 31 of the ventilating fan body 7 is mainly selected based on input power of the motor 18. An area of cross section of the power supply wire for the ventilating fan in this example is lower than 0.5 $mm^2$ according Japanese JIS specification or American A.W.G. 22 specification. Therefore, the power supply wire is thinner in diameter and more easily bent compared with the indoor electric wire. If a per-accommodating space is disposed, the power supply wire can be simply received in the per-accommodating space. The insulating sleeve of the power supply wire 31 is received in the per-accommodating space by a resilient plastic sleeve to have a U-shape. If the internal terminal 32*a* is disposed to be retractable and extensible on the back side, it can be returned to the per-accommodating space by resilience after connection. As a result, the connection operation becomes simpler.

In addition, positions of the ventilating fan body 7 and the power supply case 60 can be correctly ensured since the ventilating fan body 7 and the power supply case 60 are mounted with the ventilating fan mounting member 8 served as a base, respectively. Furthermore, the mounting can be simply and reliably carried out since size and shape of the power supply wire 31 are design by a manufacturer and disposed to the ventilating fan body 7.

Embodiment 2

Figure 4:
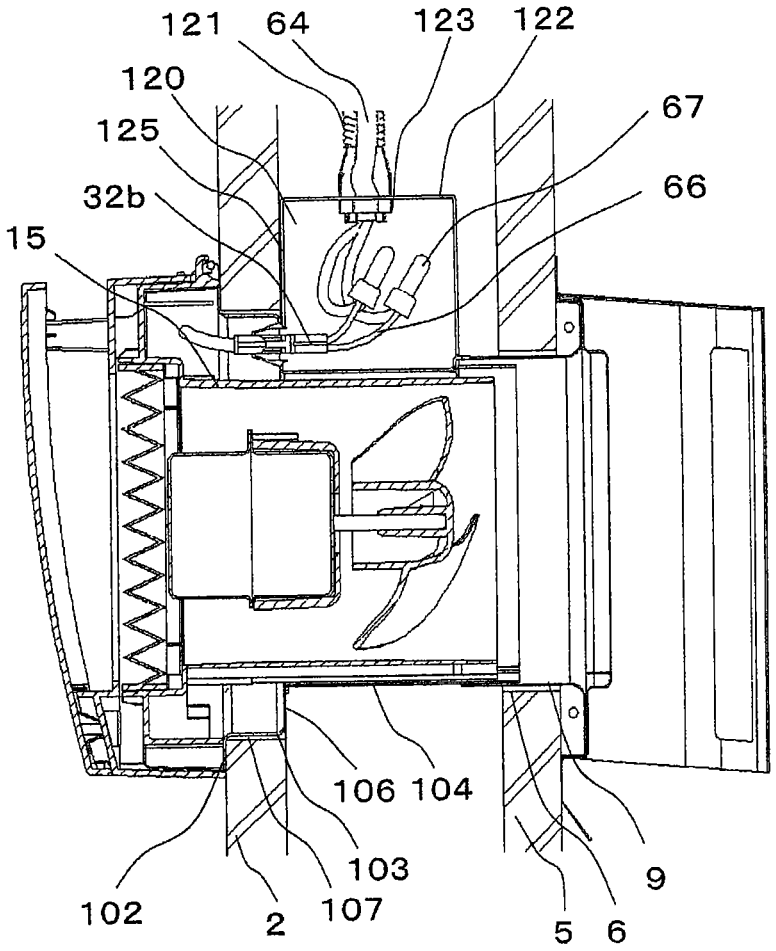
FIG. 4 is a sectional view of a mounted ventilating fan according to a second embodiment.
Figure 5:
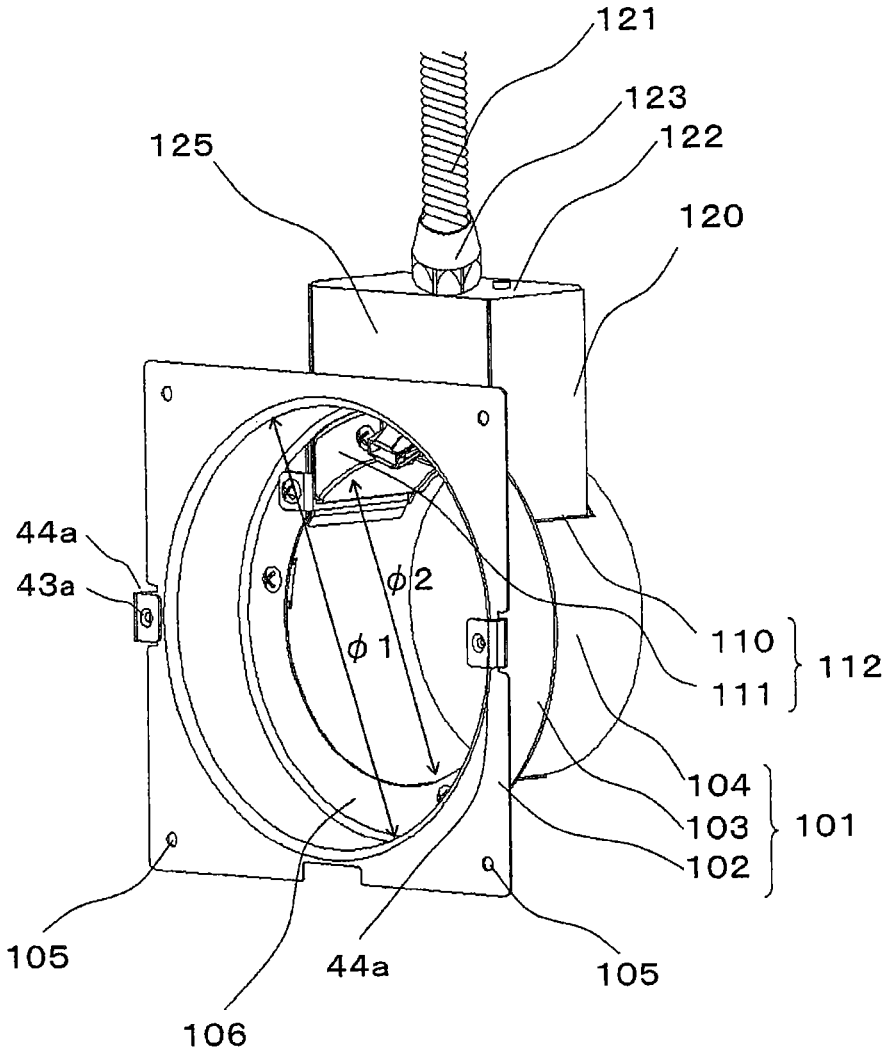
FIG. 5 is a schematic perspective view of an ventilating fan mounting member and a power supply case of the ventilating fan according to the second embodiment which have been mounted.
Figure 6A:
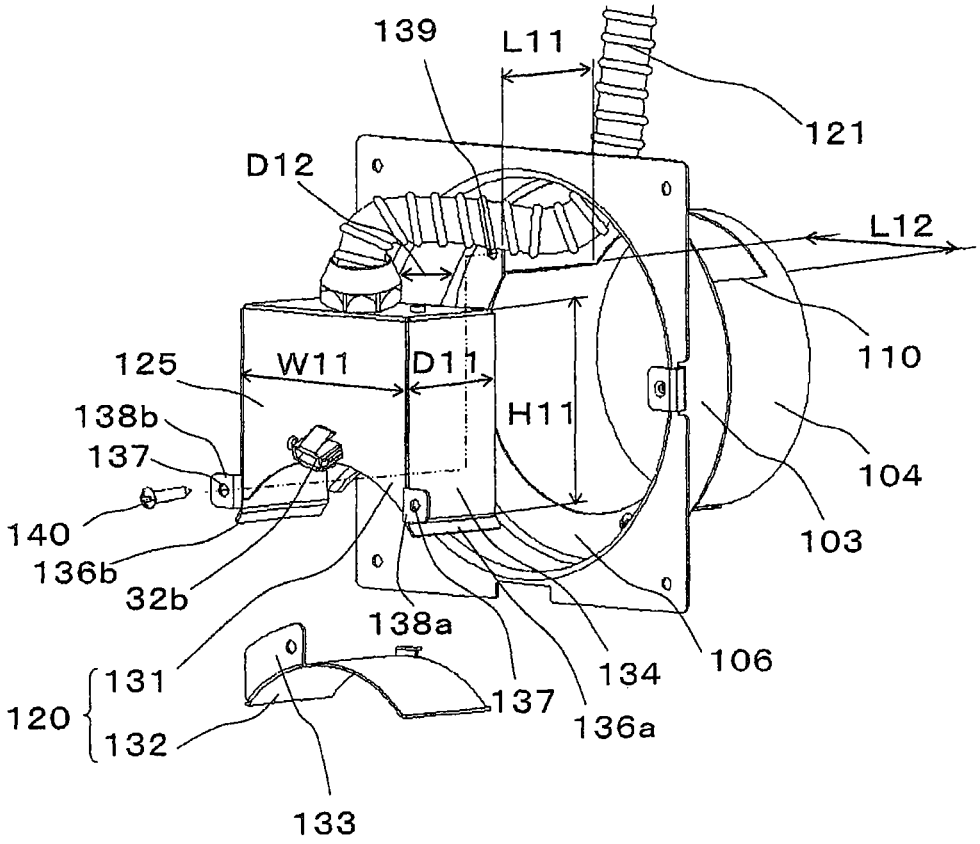
FIG. 6A is a schematic perspective view of the ventilating fan mounting member and the power supply case of the ventilating fan according to the second embodiment prior to mounting.
Figure 6B:
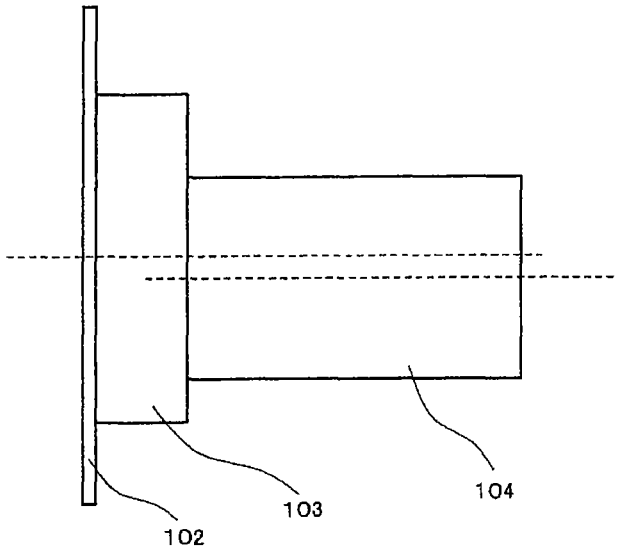
FIG. 6B is a schematic view showing first and second cylinders that are mounted with their centerlines staggered.

FIG. 4 is a sectional view of a mounted ventilating fan according to a second embodiment of the present invention, FIG. 5 is a schematic perspective view of an ventilating fan mounting member and a power supply case of the ventilating fan according to the second embodiment which have been mounted, FIG. 6A is a schematic perspective view of the ventilating fan mounting member and the power supply case of the ventilating fan according to the second embodiment prior to mounting, and FIG. 6B is a schematic view showing first and second cylinders that are mounted with their center-lines staggered.

The same elements appearing in FIGS. 4 and 5 as in FIGS. 1 and 2 are indicated by the same reference numbers and their detailed description is omitted.

As illustrated in FIGS. 4 and 5, a ventilating fan mounting member 101 comprises a component flange 102, a first cylinder 103, and a second cylinder 104. The component flange 102 is formed such that it extends radially in a generally square shape from an opening edge of an opening of the first cylinder 103 on the indoor side 1. A plurality of screw holes 105 are formed in a surface of the component flange 102 adjoining the inner wall 2. The component flange 102 is dimensioned such that it can be just assembled in the above-mentioned receiving compartment 25 formed by the back of the body flange 16. In addition, a plurality of body mounting parts 44*a* of the component flange 102 are provided with screw holes 43*a* in respective center portions of the body mounting parts 44*a*. The body mounting parts 44*a* protrude towards the indoor side 1 to have a L-shape. A diameter $\phi$1 of the first cylinder 103 is larger than a diameter $\phi$2 of the second cylinder 104, and the first cylinder 103 and the second cylinder 104 are connected to each other through a cylinder segment difference part 106.

An opening 107 of the inner wall 2 is formed in order that the first cylinder 103 can be inserted in the inner wall 2, and an outer wall opening 6 is formed in order that the auxiliary sleeve 9 disposed to extend the second cylinder 104 can be inserted in the outer wall 5.

An opening is disposed in a part of a cylindrical surface of the second cylinder 104 to serve as a third power supply opening 110, and a fourth power supply opening 111 is disposed at a part of the cylinder segment difference part 106 to adjoin the third power supply opening 110, and the fourth power supply opening 111 reaches a cylindrical surface of the first cylinder 103. In other words, the third power supply opening 110 and the fourth power supply opening 111 form a power supply opening 112 having a L-shaped section. Furthermore, a power supply case 120 is disposed to protrude outwards from the power supply opening 112.

The power supply case 120 has a shape of a box and is made of sheet metal. A flexible conduit 121 disposed between the inner wall 2 and the outer wall 5 penetrates a first top surface 122 at an upper portion of the power supply case 120, and is connected by a conduit connecting member 123. An external electric wire 64 for supplying power is arranged in the conduit 121. A surface of the power supply case 120 on the indoor side 1 is a first side 125. An external terminal 32*b* connectable with the internal terminal 32*a* is mounted at the first side 125. A terminal lead wire 66 connected with the external terminal 32*b* may be connected to the external power supply wire 64 through a close-end connector 67.

The ventilating fan mounting member 101 and the power supply case 120 will now be described in detail with referent to FIG. 6A.

As illustrated in FIG. 6A, the power supply case 120 comprises a case-shaped power supply box 131 and a power supply box cover 132. The power supply box cover 132 has an arc-shaped section shape having the same curvature as the cylindrical surface of the second cylinder 104. The power supply box cover 132 is provided with a mounting sheet 133, and a hole is formed in a center portion of the mounting sheet 133. The mounting sheet 133 adjoins the first side 125 of the power supply box 131 and is fixed to the first side 125 of the power supply case 131 with a screw. Furthermore, supporting sheets 136*a* and 136*b* are respectively disposed at a second side 134 of the power supply box 120 and a third side of the power supply box 120 opposite to the second side 134 to be parallel to an axial direction of the second cylinder 104. The supporting sheets 136*a* and 136*b* are formed such that they are bent and protruded from the power supply box 131 towards both sides in the same curvature as that at an inner diameter of the second cylinder 104.

A depth dimension D11 of the power supply case 120 is equal to an opening depth dimension L11 of the third power supply opening 110 disposed in the second cylinder 104. A width dimension W11 of the power supply case 120 is equal to an opening width dimension L12 of the fourth power supply opening 111. Furthermore, a depth dimension D12 of the first cylinder 103 is equal to or slightly larger than a thickness of the inner wall 2. Moreover, a height dimension H11 of the power supply case 120 is set such that the power supply case 120 can project above the first cylinder 103 when the power supply case 120 is disposed at the second cylinder 104. Furthermore, the width dimension W11 and the height dimension H11 of the power supply case 120 are set so that the power supply case 120 can be just inserted in the second cylinder 104.

Power supply case mounting sheets 138*a* and 138*b* are disposed at the first side 125 of the power supply box 131 to be extended outwards from both sides. The power supply case mounting sheets 138*a* and 138*b* are formed such that the power supply case mounting sheets 138*a* and 138*b* protrude from the second side 134 and the third side and are provided with screws holes 137 formed in center portions of the power supply case mounting sheets 138*a* and 138*b*. When the power supply case 120 is mounted, backs of the power supply case mounting sheets 138*a* and 138*b* adjoin the cylinder segment difference part 106 and the power supply case mounting sheets 138*a* and 138*b* can be fixed to the cylinder segment difference part 106 by passing screws 140 through screw holes 139 disposed in the cylinder segment difference part 106.

With the above configuration, the ventilating fan mounting member 101 is inserted in the opening 107 of the inner wall 2 from the indoor side 1 so that the component flange 102 adjoins the inner wall 2 and can be fixed to the inner wall 2 from the indoor side by passing screws through the plurality of screw holes 105. Meanwhile, the conduit 121, disposed in advance to coordinate with construction engineering of the building, guides the leading end of the external electric wire 64 from the opening of the component flange 102 to the indoor side 1.

The conduit 121 is connected with the power supply case 120 by means of the conduit connecting member 123. The terminal lead wire 66 is connected with the external electric wire 64 through the close-end connector 67. The remaining portions of the terminal lead wire 66 and the external electric wire 64 can be received in the power supply case 120. The height dimension H11 of the power supply case 120 can be determined according to a volume required when the remaining portions of the terminal lead wire 66 and the external electric wire 64 are received in the power supply case 120.

After that, the power supply box cover 132 covers the power supply box 131. The power supply box cover 132 may be fixed by passing screws through the mounting sheet 133.

Next, when the power supply case 120 is inserted in the second cylinder 104 in such a way that the first side 125 faces the indoor side 1, back sides of the power supply case mounting sheets 138*a* and 138*b* adjoin the cylinder segment difference part 106. In order that the power supply case 120 is projected from the fourth power supply opening 111 to move upwards, the screw holes 139 disposed in the cylinder segment difference part 106 are aligned with the screws holes 137 of the power supply case mounting sheets 138*a* and 138*b*, and then the power supply case 120 is fixed to the ventilating fan mounting member 101 by means of screws 140.

When the power supply case 120 is projected from the fourth power supply opening 111 to move upwards, the flexible conduit 121 is pushed back to the space between the inner wall 2 and the outer wall 5. The supporting sheets 136*a* and 136*b* adjoin an inner wall of the second cylinder 104 to perform a positioning function. The power supply case 120 is fixed. The third power supply opening 110 of the power supply opening 112 is covered by the power supply box cover 132, and the second cylinder 104 and the power supply box cover 132 form a cylindrical compartment which can receive the wind tunnel part 15 of the ventilating fan body 7. In addition, the fourth power supply opening 111 is covered by the first side 125 of the power supply box 131. Moreover, preparation for mounting the ventilating fan body 7 has been completed since the external terminal 32*b* can be connected and arranged from the indoor side 1.

Finally, the internal terminal 32*a*, mounted at the leading end of the power supply wire 31 led out from the body electrical case 30, is first connected with the external terminal 32*b* when the ventilating fan body 7 is mounted. Furthermore, the power supply wire 31 is received in the power supply wire receiving compartment 33, and the body fixing sections 45 of the ventilating fan body 7 is mounted to be fixed to the ventilating fan body mounting parts 44*a* of the ventilating fan mounting member 101 by screws.

Therefore, since the external electric wire 64 is connected with the terminal lead wire 66 in the power supply case 120 in advance when the ventilating fan body 7 is mounted, it is not necessary to adjust dimension of the external electric wire 64, the external electric wire 64 arranged inside the wall can be simply connected with the body power supply wire 31 through the terminals, and the present invention can achieve effect of simple mounting of the ventilating fan body 7.

In the embodiment, an annular gap between the wind tunnel part 15 and the first cylinder 103 plus the power supply wire receiving compartment 33 may function as a receiving space of the body power supply wire 31. If so, the electric connection will become simpler.

Furthermore, the opening 107 of the inner wall 2 may not be circular so long as the opening 107 can be covered by the component flange 102, since the component flange 102 is disposed. For example, if a hole is disposed in the inner wall 2 to have the same diameter as that of the outer wall opening 6, and is enlarged to form the opening 107 of the inner wall 2 in order to carry out mounting of the ventilating fan, the mounting of the ventilating fan can be easily performed. Furthermore, when center positions of the opening 107 of the inner wall 2 and the outer wall opening 6 are staggered, the auxiliary sleeve 9 may employ flexible serpentine aluminum pipe.

In addition, as illustrated in FIG. 6B, the centerlines of the first cylinder 103 and the second cylinder 104 may be disposed not to coincide with each other, and the second cylinder 104 may be formed to be staggered downwards. In this case, the fourth opening 111 will become bigger. In other words, an upper portion of the annular gap between the wind tunnel part 15 and the first cylinder 103 will become bigger to further facilitate protrusion of the power supply case 120 from the first cylinder 103 to the indoor side to conveniently carry out connection between the internal terminal 32*a* and the external terminal 32*b*

Furthermore, the diameter ϕ1 of the first cylinder 103 may be set to be smaller compared with situation where the centerlines of the first cylinder 103 and the second cylinder 104 coincide with each other.

Embodiment 3

Figure 7:
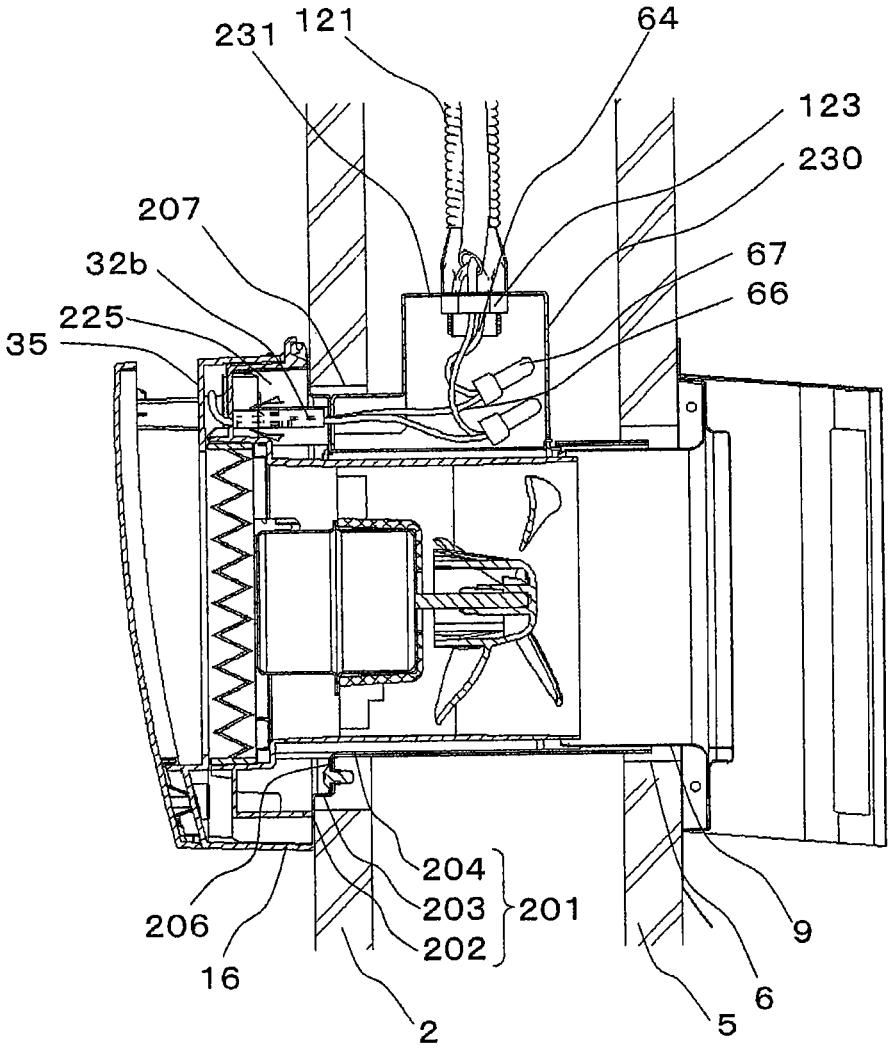
FIG. 7 is a sectional view of a mounted ventilating fan according to a third embodiment.
Figure 8:
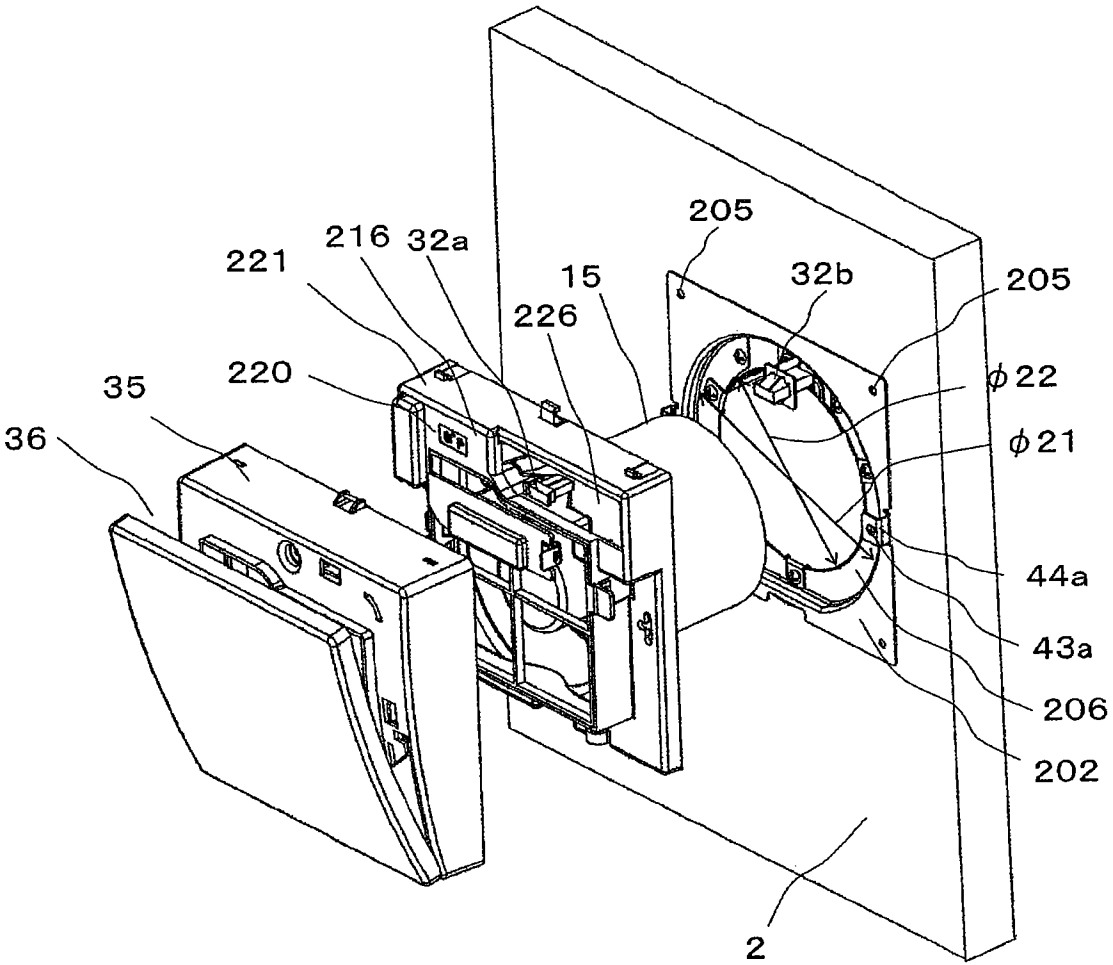
FIG. 8 is a schematic exploded perspective view of the ventilating fan according to the third embodiment.
Figure 9:
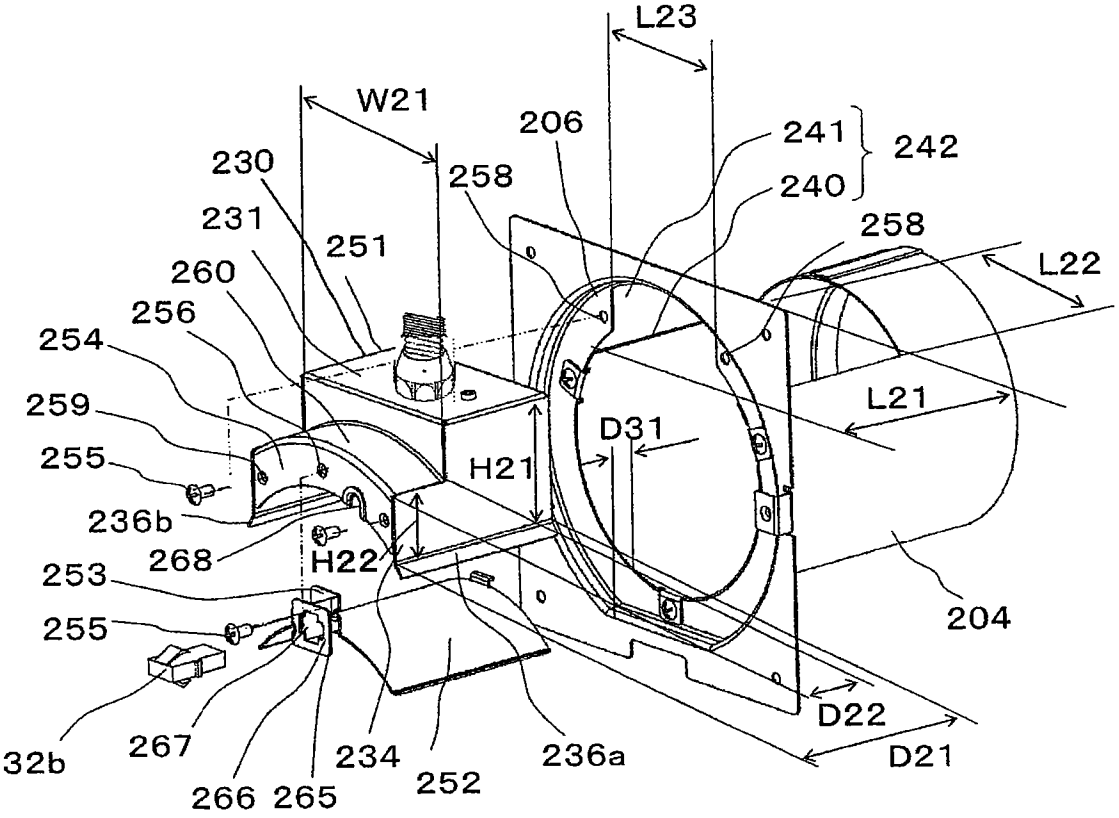
FIG. 9 is a schematic perspective view of a ventilating fan mounting member and a power supply case of the ventilating fan according to the third embodiment prior to mounting.

FIG. 7 is a sectional view of a mounted ventilating fan according to a third embodiment of the present invention, FIG. 8 is a schematic exploded perspective view of the ventilating fan according to the third embodiment, and FIG. 9 is a schematic perspective view of a ventilating fan mounting member and a power supply case of the ventilating fan according to the third embodiment prior to mounting.

The same elements appearing in FIGS. 7 and 8 as in FIGS. 4 and 5 are indicated by the same reference numbers and their detailed description is omitted.

As illustrated in FIGS. 7 and 8, a ventilating fan mounting member 201 comprises a component flange 202, a first cylinder 203, and a second cylinder 204. The component flange 202 is formed such that it extends radially in a generally square shape from an opening edge of an opening of the first cylinder 203 on the indoor side 1. The first cylinder 203 has a depth dimension less than a thickness of the inner wall 2. A plurality of screw holes 205 are formed in a surface of the component flange 202 adjoining the inner wall 2. The component flange 202 is dimensioned such that it can be just assembled in the above-mentioned receiving compartment 25 formed by the back of the body flange 16. In addition, a plurality of body mounting parts 44*a* of the component flange 202 are provided with screw holes 43*a* in respective center portions of the body mounting parts 44*a*. The body mounting parts 44*a* protrude towards the indoor side 1 to have a L-shape. A diameter ϕ21 of the first cylinder 203 is larger than a diameter ϕ22 of the second cylinder 204, and the first cylinder 203 and the second cylinder 204 are connected to each other through a cylinder segment difference part 206.

An opening 207 of the inner wall 2 is formed in order that the first cylinder 203 can be inserted in the inner wall 2, and an outer wall opening 6 is formed in order that the auxiliary sleeve 9 disposed to extend the second cylinder 204 can be inserted in the outer wall 5.

The ventilating fan body 7 comprises a wind tunnel part 15 and a body flange 216. The body flange 216 is formed such that it extends radially in a generally square shape from an opening edge of an opening of the wind tunnel part 15 on the indoor side 1. A protrusion 221 is disposed to protrude from an edge of a planar portion 220 of the body flange 216 towards a back side of the body flange 216. An end surface of the protrusion 221 adjoins the inner wall 2. Furthermore, a spatial receiving compartment 225 adjoining a back of the body flange 216 is formed by disposing the cylindrical wind tunnel part 15 of the ventilating fan body 7, the generally square planar portion 220, and the protrusion 221 of the planar portion 220 around the spatial receiving compartment 225. In addition, a terminal opening 226 is formed in the planar portion 220. The internal terminal 32*a* and the external terminal 32*b* can be connected with each other by means of a space formed by the terminal opening 226 after the ventilating fan body 7 is fixed.

In addition, a front panel 35 is detachably mounted to surround an outer periphery of the body flange 216 of the ventilating fan body 7.

The power supply case 230 has a shape of a box and is made of sheet metal. A flexible conduit 121 disposed between the inner wall 2 and the outer wall 5 penetrates a first top surface 231 at an upper portion of the power supply case 230, and is connected by a conduit connecting member 123. An external electric wire 64 for supplying power is arranged in the conduit 121. The external terminal 32*b* connectable with the internal terminal 32*a* is mounted in the power supply case 230. A terminal lead wire 66 connected with the external terminal 32*b* may be connected to the external power supply wire 64 through a close-end connector 67.

The ventilating fan mounting member 201 and the power supply case 230 will now be described in detail with referent to FIG. 9.

As illustrated in FIG. 9, an opening is disposed in a part of a cylindrical surface of the second cylinder 204 to serve as a fifth power supply opening 240, and a sixth power supply opening 241 is disposed at a part of the cylinder segment difference part 206 to adjoin the fifth power supply opening 240.

In other words, the fifth power supply opening 240 and the sixth power supply opening 241 form a power supply opening 242 having an L-shaped section. Furthermore, the power supply case 230 is disposed to protrude outwards from the power supply opening 242.

The power supply case 230 comprises a case-shaped power supply box 251 and a power supply box cover 252. The power supply box cover 252 has an arc-shaped section shape having the same curvature as the cylindrical surface of the second cylinder 204. A mounting sheet 253 is disposed at an upper portion of a front end of the power supply box cover 252 near the indoor side, and a hole is formed in a center portion of the mounting sheet 253. The mounting sheet 253 adjoins the first side 254 of the power supply box 251 and is fixed to the first side 254 of the power supply case 251 by passing a screw 255 through a screw hole 256 for the power supply box cover 252 disposed in the first side 254. Furthermore, the mounting sheet 253 is formed in a L-shape 265 towards the indoor side 1. A terminal mounting opening 267, to which the external terminal 32*b* can be mounted, is formed in a protruding sheet 266 of the mounting sheet 253. In addition, in order to lead out the terminal lead wire 66 connected with the external terminal 32*b*, a U-shaped opening 268 is disposed in the first side 254. The protruding sheet 266 is located adjacent to the opening 268. Therefore, it is easy for the external terminal 32*b* to be mounted to the terminal mounting opening 267 of the protruding sheet 266 after projecting from the opening 268, and also for the external terminal 32*b* to be connected with the internal terminal 32*a* at this position. In addition, supporting sheets 236*a* and 236*b* are respectively disposed at a second side 234 of the power supply box 230 and a third side of the power supply box 230 opposite to the second side 234 to be parallel to an axial direction of the second cylinder 204. The supporting sheets 236*a* and 236*b* are formed such that they are bent and protruded from the power supply box 251 towards both sides in the same curvature as that at an inner diameter ϕ22 of the second cylinder 204.

A depth dimension D21 of the power supply case 230 is equal to an opening depth dimension L21 of the fifth power supply opening 240 disposed in the second cylinder 204. A width dimension W21 (an outer dimension measured from the second side 234 to the third side) of the power supply case 230 is equal to an opening width dimension L22 of the sixth power supply opening 241 orthogonal to an opening width dimension L21 of the sixth power supply opening 241. Furthermore, a width L23 of the sixth power supply opening 241 is less than the width dimension W21 of the power supply case 230. In other words, left and right portions of the cylinder segment difference part 206 cover the first side 254 to overlap the first side 254. The portions of the cylinder segment difference part 206 overlapping the first side 254 are provided with screw holes 258.

Furthermore, when the power supply, case 230 is mounted, a back side of the cylinder segment difference part 206 adjoins the first side 254 and the power supply case 230 is fixed to the cylinder segment difference part 206 by passing the screws 255 through screw holes 258 and then through screw holes 259 disposed in the cylinder segment difference part 206.

A segment difference is disposed at a first top surface 231 at the upper portion of the power supply case 230 to form a second top surface 260 in the same curved surface as that at a diameter ϕ21 of the first cylinder 203. A depth dimension D22 of the second top surface 260 is larger than a dimension derived by subtracting a depth dimension D31 of the first cylinder 203 from a thickness of the inner wall 2. Since the segment difference is formed between the first top surface 231 and the second top surface 260, a height dimension of the power supply case 230 (a height dimension of the second side 234 and the third side) refers to a height dimension H21 measured from the supporting sheet 236*a* or 236*b* to the first top surface 231, and a height dimension H22 measured from the supporting sheet 236*a* or 236*b* to the second top surface 260. In addition, it is most ideal to set the height dimension H22 to be able to accommodate the mounting sheet 253 connected with the first side 254 of the power supply case 230, and to set the height dimension H22 to a minimum dimension to enable the external terminal 32*b* to be mounted to the first side 254, in consideration of operability of formation of the inner wall opening 3 in the inner wall 2.

Furthermore, the width dimension W21 and the height dimension H21 of the power supply case 230 are set so that the power supply case 230 can be inserted in the second cylinder 204.

With the above configuration, the ventilating fan mounting member 201 is inserted in the opening 207 of the inner wall 2 from the indoor side 1 so that the component flange 202 can be fixed to the inner wall 2 from the indoor side by passing screws through the plurality of screw holes 205. Meanwhile; the conduit 121, disposed in advance to coordinate with construction engineering of the building, guides the leading end of the external electric wire 64 from the opening of the component flange 202 to the indoor side 1.

The conduit 121 is connected with the power supply case 230 by means of the conduit connecting member 123. The external terminal 32*b* is mounted to the terminal mounting opening 267, and the terminal lead wire 66 may be connected with the external electric wire 64 through the close-end connector 67. The remaining portions of the terminal lead wire 66 and the external electric wire 64 can be received in the power supply case 230. The height dimension H21 of the power supply case 230 can be determined according to a volume required when the remaining portions of the terminal lead wire 66 and the external electric wire 64 are received in the power supply case 230.

After that, the terminal lead wire 66 is passed through the U-shaped opening 268 into the power supply case 230, and the power supply box cover 252 covers the power supply box 251, and may be fixed by passing a screw through the mounting sheet 253.

Next, when the power supply case 230 is inserted in the second cylinder 204 in such a way that the first side 254 of the power supply case 230 faces the indoor side 1, a back side of the cylinder segment difference part 206 adjoins the first side 254 of the power supply case 230. In order that the power supply case 230 is projected from the fifth power supply opening 240 to move upwards, the screw holes 259 are aligned with the screws holes 258, and then the power supply case 230 is fixed to the ventilating fan mounting member 201 by means of screws 255.

When the power supply case 230 is projected from the fifth power supply opening 240 to move upwards, the supporting sheets 236*a* and 236*b* adjoin an inner wall of the second cylinder 204 to perform a positioning function. When the power supply case 230 is fixed, the fifth power supply opening 240 of the power supply opening 242 is covered by the power supply box cover 252, and the second cylinder 204 and the power supply box cover 252 form a cylindrical compartment which can receive the wind tunnel part 15 of the ventilating fan body 7. In addition, the sixth power supply opening 241 is covered by the first side 254 of the power supply box 251. Moreover, preparation for mounting the ventilating fan body 7 has been completed since the external terminal 32*b* can be connected and arranged from the indoor side 1.

Finally, when the ventilating fan body 7 is mounted, firstly the front panel 27 is removed, and then the body fixing sections 45 of the ventilating fan body 7 is mounted to be fixed to the ventilating fan body mounting parts 44*a* of the ventilating fan mounting member by screws.

In addition, the internal terminal 32*a*, mounted at the leading end of the power supply wire 31 led out from the body electrical case 30, is connected with the external terminal 32*b*. The connection operation may be performed through the terminal opening 226 after the ventilating fan body 7 is fixed. Furthermore, the terminal opening 226 is covered with the front panel 35 by mounting the front panel 35. The mounting operation of the ventilating fan is completed.

Therefore, since the external electric wire 64 is connected with the terminal lead wire 66 in the power supply case 230 in advance when the ventilating fan body 7 is mounted, it is not necessary to adjust dimension of the external electric wire 64. In addition, the connection operation of the external terminal 32*b* may be performed through the terminal opening 226 after the ventilating fan body 7 is fixed. The external electric wire 64 arranged inside the wall can be simply connected with the body power supply wire 31 through the terminals, and the present invention can achieve effect of simple mounting of the ventilating fan body 7.

The depth dimension of the first cylinder 203 of the third embodiment may be set less than the depth dimension of the first cylinder 103 of the second embodiment. Therefore, the power supply case 230 is expanded toward the indoor side. Since the volume of the power supply case 230 can be ensured, the height dimension H21 of the power supply case 230 can be inhibited. If the wall 2 is thick, the height of the power supply case 230 can be inhibited, too.

Embodiment 4

Figure 10:
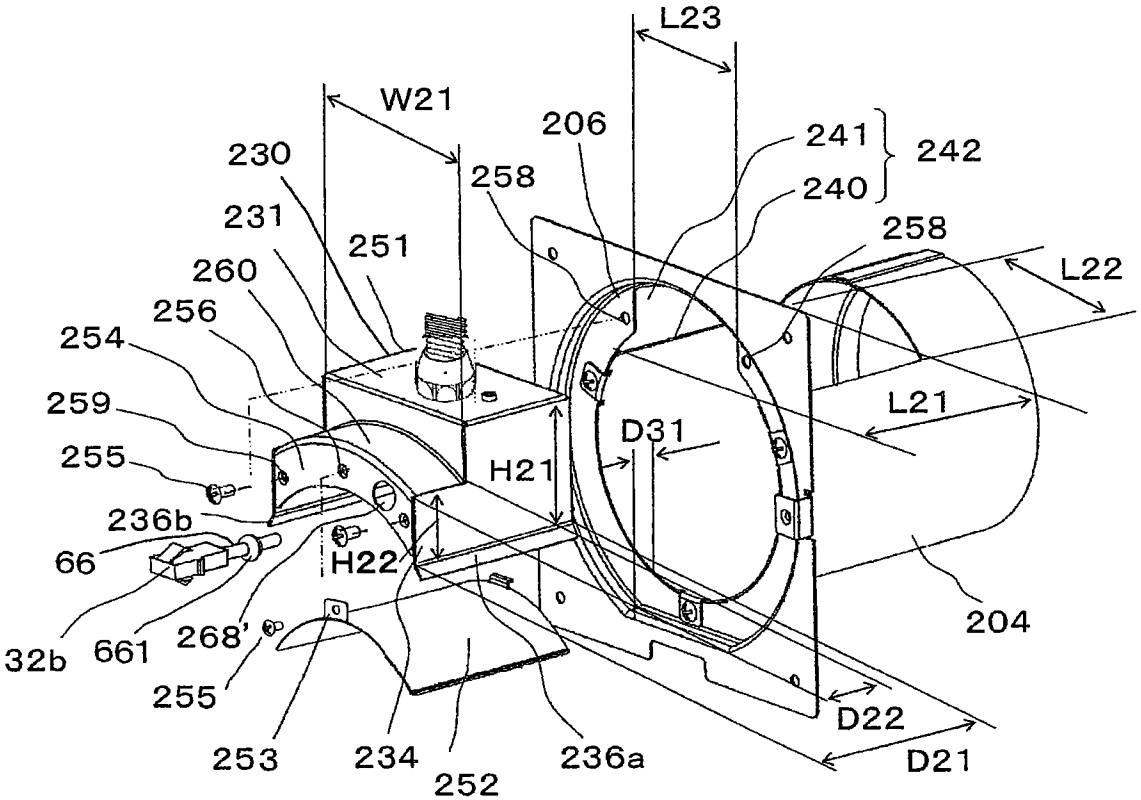
FIG. 10 is a schematic perspective view of an ventilating fan mounting member and a power supply case of a ventilating fan according to a fourth embodiment prior to mounting.
Figure 11:
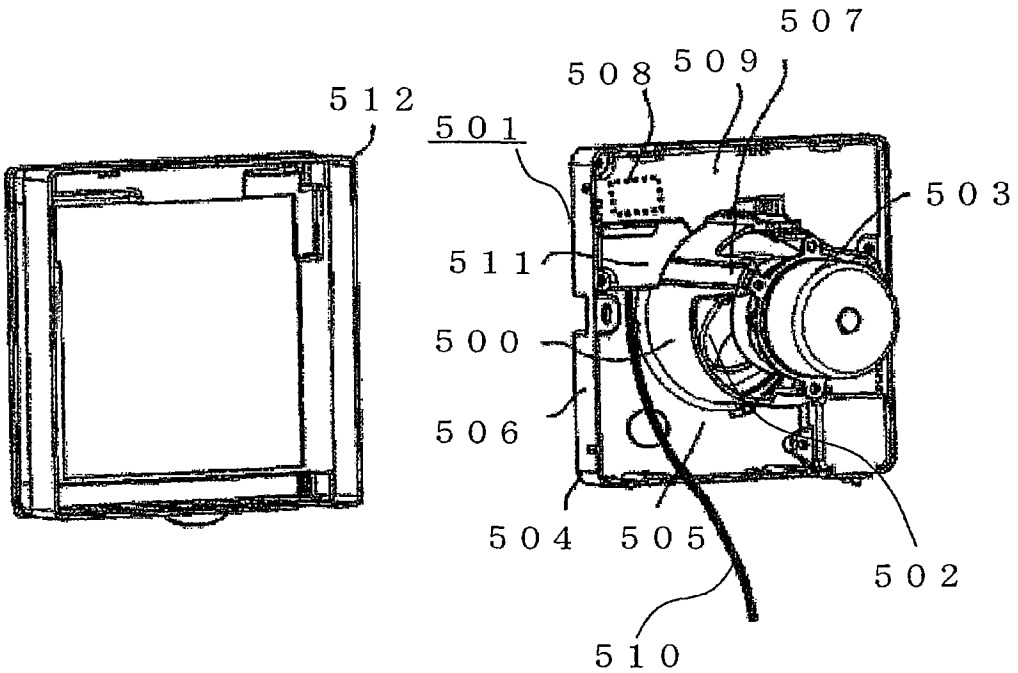
FIG. 11 is a schematic view of a ventilating fan in prior art.

FIG. 10 is a schematic perspective view of a ventilating fan mounting member and a power supply case of a ventilating fan according to a fourth embodiment prior to mounting.

In the present invention, it is not necessary to fix the external terminal 32*b* to the power supply case 230. Instead, the external terminal 32*b* may be disposed at the leading end of the terminal lead wire 66 projected from the power supply case 230, and located in the space among the ventilating fan body 7, the ventilating fan mounting member 8, and the power supply case 230. The fourth embodiment of the present invention describes such a case.

In the embodiment, a locking piece 661 is disposed on the terminal lead wire 66. After the external terminal 32*b* is projected from the opening 268', the locking piece 661 is locked at the opening 268' so that the external terminal 32*b* is fixed in a space on the indoor side of the power supply case 230. The to opening 268' may be a notch such as the U-shaped opening 268 disposed in the first side 254 as shown in FIG. 9, or a hole such as the opening 268' formed in the first side 254 as shown in FIG. 10.

Accordingly, the fourth embodiment does not need to dispose the structure such as the protruding sheet 266, and the terminal mounting opening 267 like the third embodiment.

The other elements, structures, connecting and mounting methods between the elements in the fourth embodiment are the same as in the third embodiment. The detailed description of the remaining elements, indicated with reference characters, and the like shown in FIG. 10 is not repeated and the third embodiment can be referred to for the remaining elements and the like.

What is claimed is:

1. A ventilating fan comprising a ventilating fan body, a ventilating fan mounting member, and a power supply case, wherein:

the ventilating fan mounting member is disposed at a penetrating section formed between an inner wall and an outer wall to mount the ventilating fan body;

the ventilating fan body comprises a wind tunnel part, a body flange, a blower for blowing through the penetrating section, a power supply wire connected to the blower, and an internal terminal disposed at a leading end of the power supply wire;

the ventilating fan mounting member comprises a cylinder and a component flange, the cylinder has a cylindrical wall and is provided with a power supply opening formed in the cylindrical wall, and the component flange is formed to protrude towards an outer periphery from an opening edge of the cylinder on an indoor side;

the power supply case projects from the power supply opening to be located outside the cylinder, and is fixed to the ventilating fan mounting member from the indoor side, at least a portion of the power supply case is disposed between the inner wall and the outer wall and abuts against an edge of the power supply opening;

the power supply case comprises:

a power supply box having a bottom opening; and a power supply box cover having an arc-shaped section, the arc-shape of the arc-shaped section having a same curvature as a cylindrical surface of the cylinder and the power supply box cover covering the power supply opening of the cylinder and the bottom opening of the power supply box;

an external terminal is mounted on an indoor side of the power supply case; and the ventilating fan is supplied with electric power with an external electric wire connected with the external terminal in the power supply case, and the internal terminal is connected with the external terminal.

2. The ventilating fan of claim 1, wherein the component flange is provided with a plurality of body mounting parts, the body flange is provided with a plurality of body fixing sections, and the ventilating fan body is mounted to be fixed to the ventilating fan mounting member by mounting the body fixing sections to the body mounting parts.

3. The ventilating fan of claim 1, wherein an inner wall opening disposed in the inner wall to form the penetrating section is configured to match with the cylinder of the ventilating fan mounting member and a shape of the power supply case, and a part of the cylinder of the ventilating fan mounting member and a part of the power supply case are located in the inner wall opening.

4. The ventilating fan of claim 3, wherein the cylinder of the ventilating fan mounting member is a two-segment cylinder having first and second cylinders, the first cylinder has a depth dimension less than a thickness of the inner wall, and a diameter of the first cylinder is larger than a diameter of the second cylinder.

5. The ventilating fan of claim 1, wherein an opening, through which a terminal lead wire of the external terminal is projected, is disposed on the indoor side of the power supply case.

6. The ventilating fan of claim 1, wherein a terminal opening is formed in the body flange, and a space formed by the terminal opening is used for connection between the internal terminal and the external terminal.

7. The ventilating fan of claim 1, further comprising a front panel disposed to surround an outer periphery of the body flange of the ventilating fan body and being detachably mounted.

8. A ventilating fan comprising: a ventilating fan body, a ventilating fan mounting member, and a power supply case, wherein:

the ventilating fan mounting member is disposed at a penetrating section formed between an inner wall and an outer wall to mount the ventilating fan body;

the ventilating fan body comprises a wind tunnel part, a body flange, a blower for blowing through the penetrating section, a power supply wire connected to the blower, and an internal terminal disposed at a leading end of the power supply wire;

the ventilating fan mounting member comprises a cylinder and a component flange, the cylinder has a cylindrical wall and is provided with a power supply opening formed in the cylindrical wall, and the component flange is formed to protrude towards an outer periphery from an opening edge of the cylinder on an indoor side;

the power supply case projects from the power supply opening to be located outside the cylinder, and is fixed to the ventilating fan mounting member from the indoor side;

an external terminal is mounted on an indoor side of the power supply case; and the ventilating fan is supplied with electric power with an external electric wire connected with the external terminal in the power supply case, and the internal terminal is connected with the external terminal;

the cylinder of the ventilating fan mounting member is a two-segment cylinder having first and second cylinders, the first cylinder has a depth dimension less than or equal to a thickness of the inner wall, and a diameter of the first cylinder is larger than a diameter of the second cylinder;

a third power supply opening is disposed in a cylindrical surface of the second cylinder, and a fourth power supply opening is disposed in a segment difference part between the first and second cylinders to adjoin the third power supply opening, the fourth power supply opening reaches a cylindrical surface of the first cylinder, and the third and fourth openings form a power supply opening corresponding to the power supply case together; and the inner wall opening disposed in the inner wall to form the penetrating section is disposed to match with a size of the first cylinder, and a part of the first cylinder is located in the inner wall opening.

9. The ventilating fan of claim 8, wherein a centerline of the first cylinder and a centerline of the second cylinder do not coincide with each other, and the second cylinder is formed to be staggered downwards.

* * * * *